US005494227A

United States Patent [19]

Costantini

[11] Patent Number: 5,494,227

[45] Date of Patent: Feb. 27, 1996

[54] HIGH PRESSURE SCREEN SHOWER

[75] Inventor: John J. Costantini, Wallingford, Conn.

[73] Assignee: Dorr-Oliver Incorporated, Milford, Conn.

[21] Appl. No.: 253,671

[22] Filed: Jun. 3, 1994

[51] Int. Cl.[6] ..... B05B 3/18; D21F 1/32

[52] U.S. Cl. ..... 239/752; 239/263; 239/264; 134/172; 162/277

[58] Field of Search ..... 239/225.1, 263, 239/264, 750, 752; 134/172; 162/277; 198/619

[56] References Cited

U.S. PATENT DOCUMENTS

| | | | |
|---|---|---|---|
| 1,459,161 | 6/1923 | Roberts | 162/277 |
| 3,563,474 | 2/1971 | Robinson | 134/172 |
| 3,642,208 | 2/1972 | Guth | 239/255 |
| 3,897,906 | 8/1975 | Bachner | 239/752 |
| 4,087,320 | 5/1978 | Danahy et al. | 162/252 |
| 4,255,906 | 3/1981 | Hockett | 51/429 |
| 4,256,511 | 3/1981 | Atchison et al. | 239/752 |
| 4,457,423 | 7/1984 | Stoll | 198/619 |
| 4,605,472 | 8/1986 | Nakamura | 162/277 |
| 4,701,242 | 10/1987 | Scarano et al. | 239/752 |
| 5,040,733 | 8/1991 | Allen | 239/752 |
| 5,228,467 | 7/1993 | Gilliam, Jr. et al. | 134/172 |
| 5,273,059 | 12/1993 | Gross et al. | 134/172 |
| 5,282,575 | 2/1994 | Krulick et al. | 239/752 |
| 5,388,526 | 2/1995 | Imai | 198/619 X |

FOREIGN PATENT DOCUMENTS

| | | | |
|---|---|---|---|
| 2738666 | 3/1979 | Germany | 134/172 |
| 103708 | 1/1963 | Netherlands . | |
| 1402348 | 8/1975 | United Kingdom | 239/752 |

*Primary Examiner*—Andres Kashnikow
*Attorney, Agent, or Firm*—DeLio & Peterson

[57] ABSTRACT

A shower system comprising a header having a fluid inlet port, a plurality of substantially vertically aligned spray nozzles attached consecutively to said header and arranged in a substantially arcuate formation, and a drive system for laterally reciprocating said header.

6 Claims, 4 Drawing Sheets

HIGH PRESSURE SCREEN SHOWER

BACKGROUND OF THE INVENTION

1. Field of the Invention

The present invention relates to a shower system and method for cleaning a screen surface of a screening apparatus.

2. Problem to be Solved

Conventional shower systems for cleaning screen surfaces have included fixed pipe systems, translating pipe systems, rotating pipe systems and systems that comprise a combination of the translating pipe system and rotating pipe system. Typically, in the aforementioned combination systems, a movement arm having a plurality of spray nozzles along the length thereof is reciprocated in a longitudinal direction and rotated axially. Such a system is shown in commonly assigned U.S. Pat. No. 5,282,575 (the "'575 patent"). In the '575 patent, axial rotation is provided by a thrust created by liquid jets emanating from nozzles that are angled downward so as to produce the thrust. Such a system is inefficient because a substantial portion of the cleaning liquid is used to axially rotate the movement arm rather than clean the screen surface. Furthermore, the system disclosed in the '575 patent is bulky due to the utilization of components that are needed to effect axial rotation of the movement arm.

Bearing in mind the problems and efficiencies of conventional shower systems, it is therefore an object of the present invention to provide a new and improved shower system in which substantially all of the water distributed from the system is used to clean the screen surface of the screening apparatus.

It is another object of the invention to provide a new and improved shower system which is smaller in size than conventional shower systems and can be manufactured at a reasonable cost.

SUMMARY OF THE INVENTION

A shower system comprising a header having a fluid inlet port, a plurality of substantially vertically aligned spray nozzles attached consecutively to the header and arranged in a substantially arcuate formation, and a drive system for laterally reciprocating the header. The drive system comprises a cylinder having a first end and a second end wherein the cylinder has an air inlet adjacent each of the cylinder ends for introducing pressurized air into said cylinder. The header is slidably mounted upon said cylinder. A piston is disposed within the cylinder and is magnetically coupled to the header. The piston moves laterally in response to air pressure within the cylinder. A control system supplies pressurized air to each of the air inlets in an alternate fashion to effect a bi-directional lateral movement of the piston. The system also includes an elongate support member substantially parallel to the cylinder wherein the header is slidably engaged with the elongate member. The system further includes a torque bar substantially parallel to the elongate member and the cylinder wherein the header is also slidably engaged with the torque bar. The torque bar prevents the header from axially rotating about the elongate member in response to a thrust produced by liquid jets that emanate from the plurality of nozzles during operation of the system. During operation of the system, the header is fluidly connected to a high pressure fluid source.

BRIEF DESCRIPTION OF THE DRAWINGS

For a fuller understanding of the invention, reference should be made to the following description taken in connection with the accompany drawings, in which.

DESCRIPTION OF THE PREFERRED EMBODIMENTS

Figure 1:
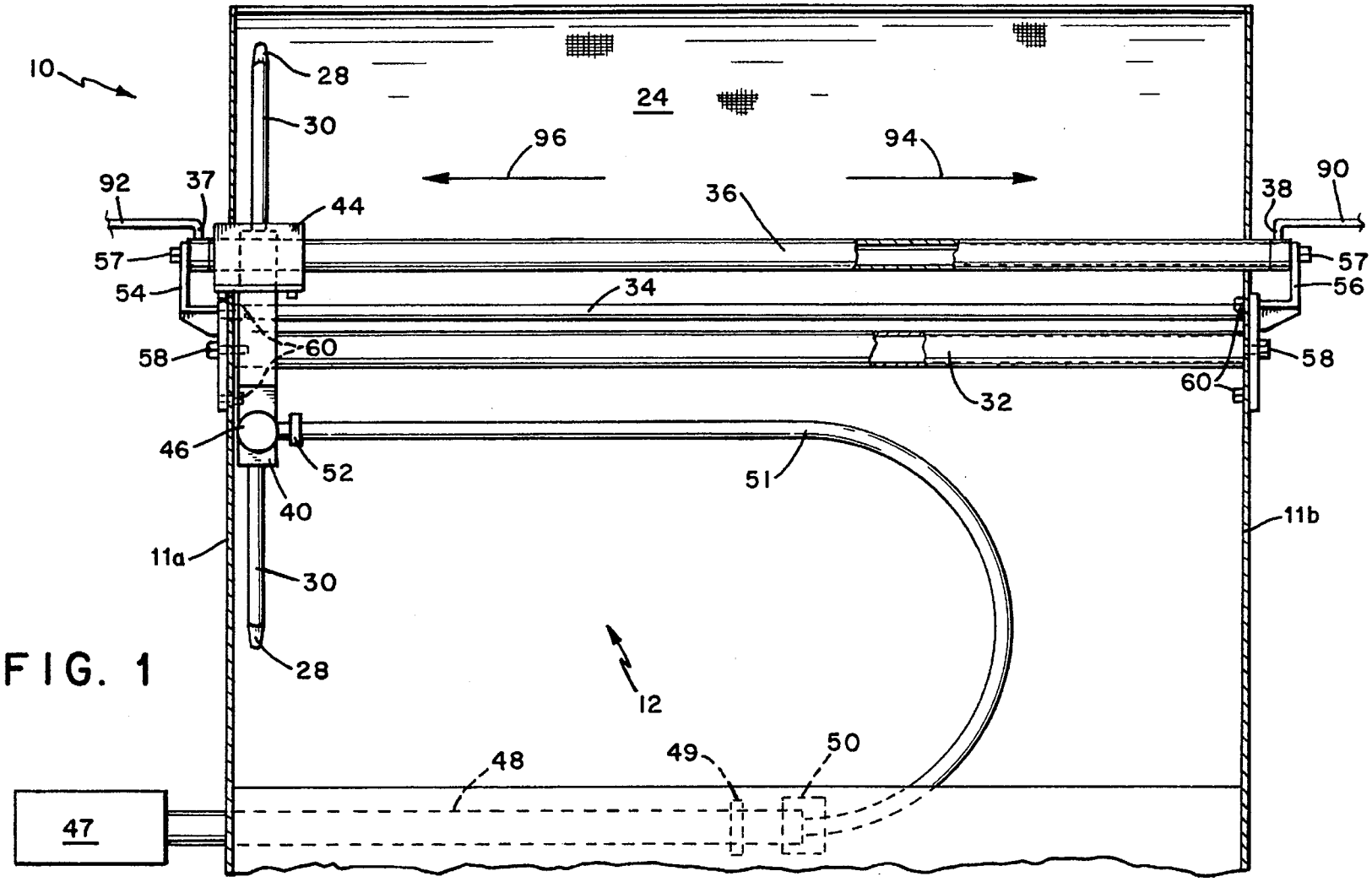
FIG. 1. is a front elevational view of a screening machine utilizing a shower system incorporating features of the present invention.

Referring to FIG. 1, there is shown a front elevational view of a screening machine 10 having a shower system 12 incorporating features of the present invention. Screening machine 10 is the same type of screening machine disclosed in U.S. Pat. No. 5,282,575, the disclosure of which is incorporated herein by reference. Although the present invention will be described with reference to the single embodiment shown in the drawings, it should be understood that the present invention can be incorporated into various different types of embodiments.

Figure 2:
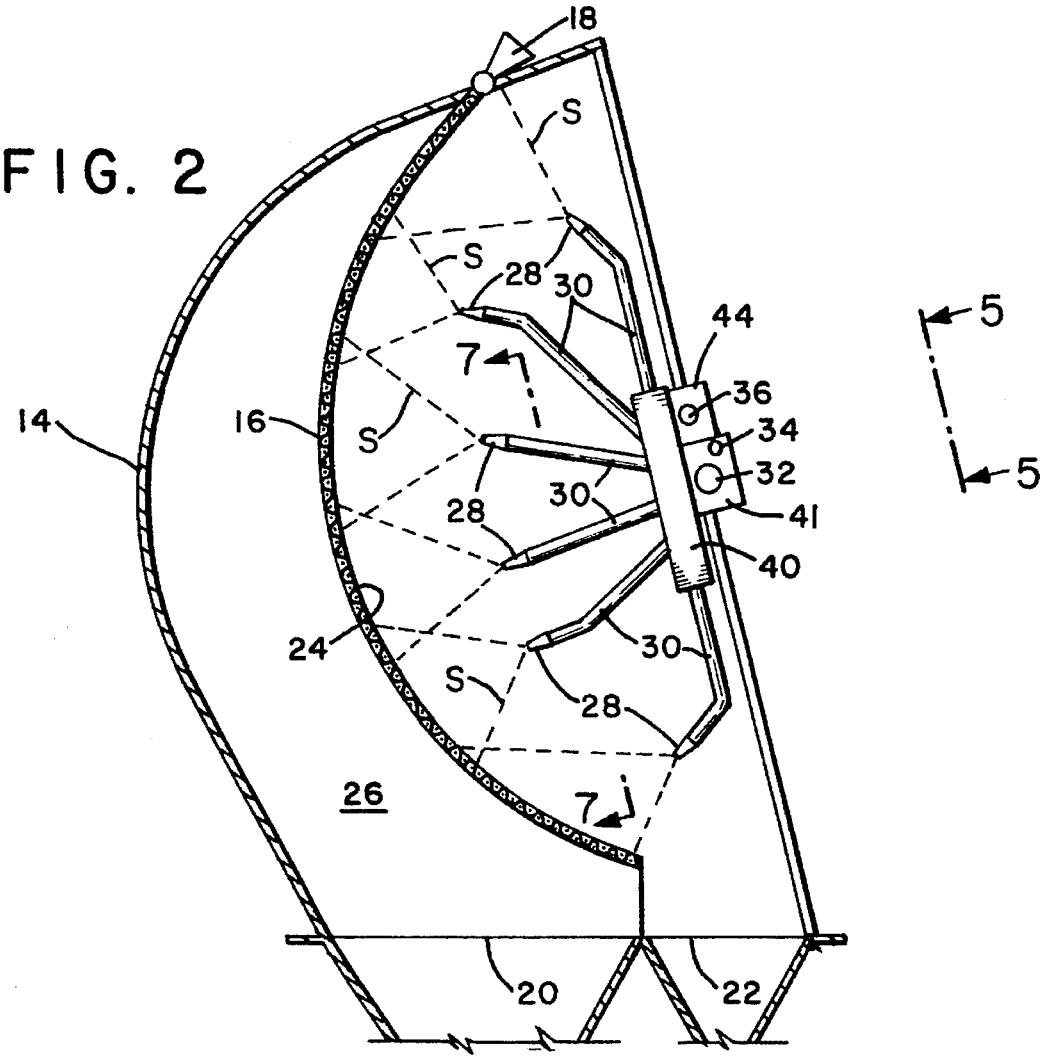
FIG. 2 is a schematic side view of the screening machine as shown in the FIG. 1.

Referring to FIG. 2, screening machine 10 includes housing 14, arcuate screen 16, a top feed or pulp inlet 18, and bottom outlets 20 and 22. Pulp is injected into machine 10 at inlet 18 and travels down along inside surface 24 of screen 16. Small particles travel through the screen 16 into the rear area 26 and outlet 20. Larger particles, not small enough to pass through the screen 16, travel down the inside surface 24 and out the second outlet 22. Thus, screening machine 10 is adapted to separate pulp or feed particles by size.

In order to keep the machine operating properly, screen 16 must be occasionally cleaned. Thus, shower system 12 is provided to clean screen 16. Shower system 12 generally comprises header 40, support pipe 32, torque bar 34 and pneumatic drive cylinder 36.

Figure 3:
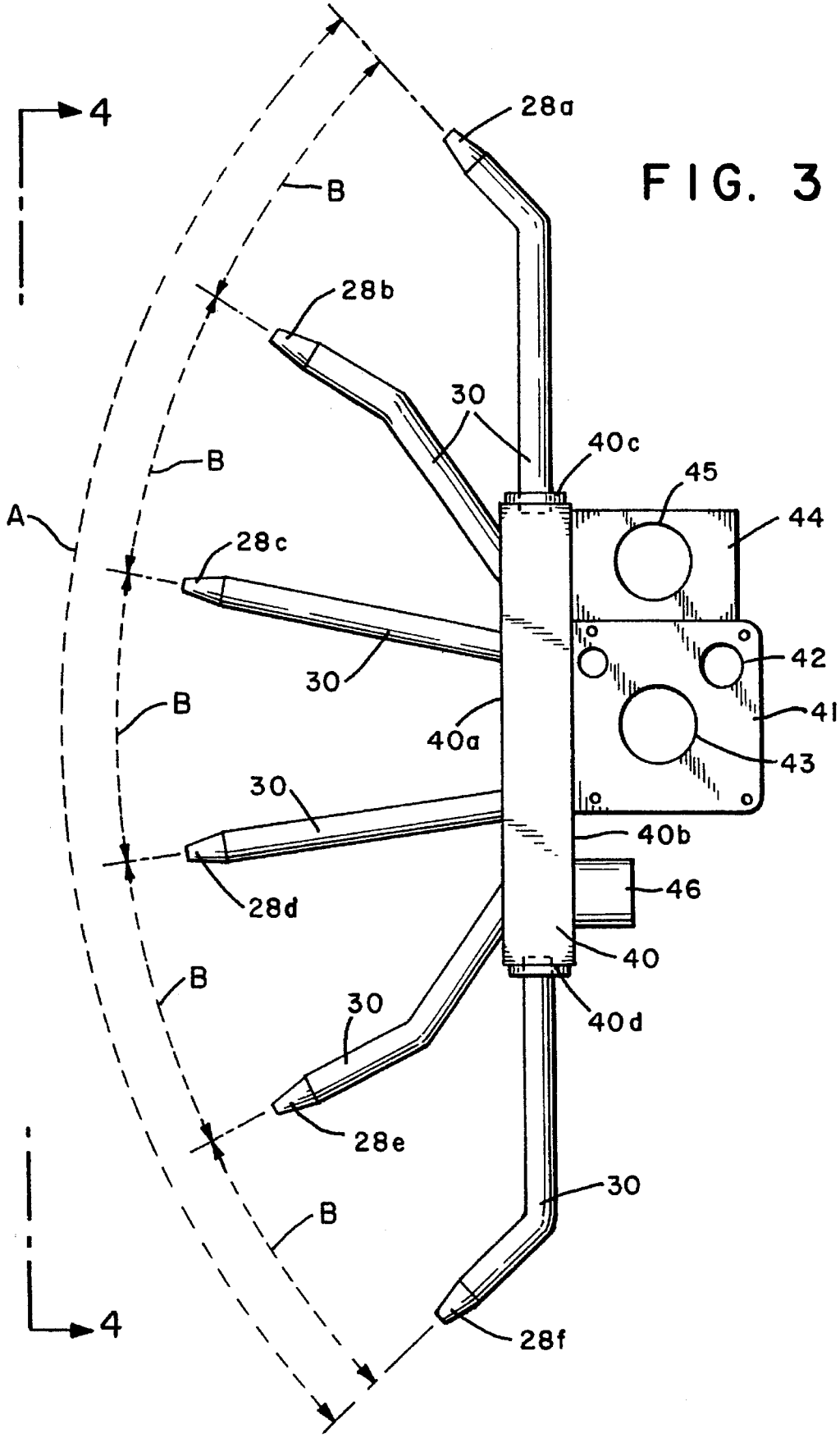
FIG. 3 is an enlarged view of the header and nozzle assembly utilized in the shower system of FIG. 1.
Figure 4:
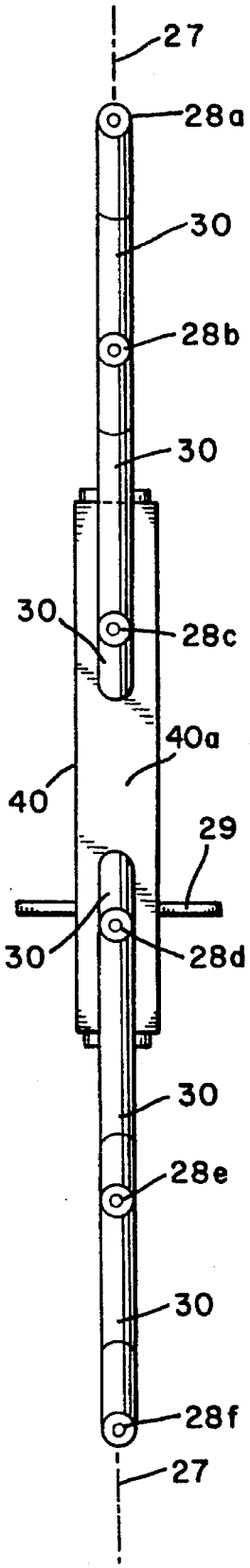
FIG. 4 is a view taken along the line 4—4 of FIG. 3.

Referring to FIGS. 3 and 4, nozzle pipes 30 are fluidly and consecutively attached to front portion 40a of header 40. Header 40 receives fluid through fluid inlet port 46 and distributes the fluid to nozzle pipes 30 via channels within header 40. Each pipe 30 has a nozzle 28 fluidly connected thereto. Nozzle pipes 30 are attached to header 40 in a manner such that nozzles 28 are vertically aligned in the same plane, as indicated by dotted line 27, and are arranged in an arcuate formation as indicated by dotted arcuate line A. It has been found that liquid jets emanating from a vertical nozzle arrangement, as shown in FIG. 3., pierce the flow of feed flowing along surface 24 of screen 16 and contact screen surface 24. It has also been found that the arcuate formation of nozzles 28*a–f* effects accurate direction of fluids against arcuate screen surface 24 which results in efficient cleaning thereof. Uppermost nozzle 28*a* is attached to top or upper portion 40*c* of header 40. Lowermost nozzle 28*f* is attached to bottom or lower portion 40*d* of header 40. The centerline spacing between nozzles 28*a* and 28*f* is indicated by dotted line A. Uppermost nozzle 28*a* and lowermost nozzle 28*f* are centerline spaced between 90 degrees and 110 degrees apart. The centerline spacing between each nozzle is indicated by dotted lines B. In a preferred embodiment, nozzles 28*a* and 28*f* are centerline spaced 100 degrees apart and nozzles 28*a–f* are centerline spaced 20 degrees apart. The aforementioned preferred embodiment of nozzle centerline spacing and the arcuate formation of nozzles 28*a–f* effect full coverage of arcuate screen surface 24 which typically has a longitudinal arc of about 120 degrees. Thus, since there are six (6) nozzles 28*a–f*, each nozzle corresponds to 20 degrees (longitudinally) of arcuate screen surface 24.

Figure 5:
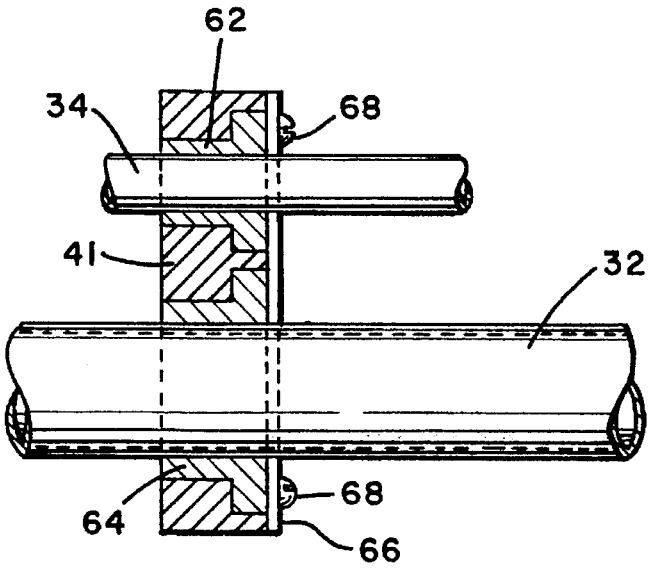
FIG. 5 is a partial cross-sectional view taken along 5—5 of FIG. 2.

Referring to FIGS. 3 and 5, bearing lock 41 is attached to the rear portion or side 40*b* of header 40. Bearing block 41 has bores 42 and 43 therein. Bore 42 receives bearing 62 which slidably receives torque bar 34. Similarly, bore 43 receives bearing 64 which slidably receives support pipe 32. Carriage 44 is attached to the top portion of bearing block 41. Carriage 44 has a bore 45 therein for slidably receiving cylinder 36. In a preferred embodiment bearing block 41 is welded to header 40 and carriage 44 is bolted to mounting plate 29 which is attached to header 40. Referring to FIG. 5, retainer plate 66 is attached to bearing block 41 to prevent bearings 62 and 64 from becoming dislodged from bearing block 41. In a preferred embodiment, plate 66 is fastened to bearing block 41 via screws 68. Bearings 62, 64, in conjunction with bearing block 41, allow header 40 to smoothly longitudinally slide along support pipe 32 and torque bar 34 with a minimum amount of friction.

Figure 6:
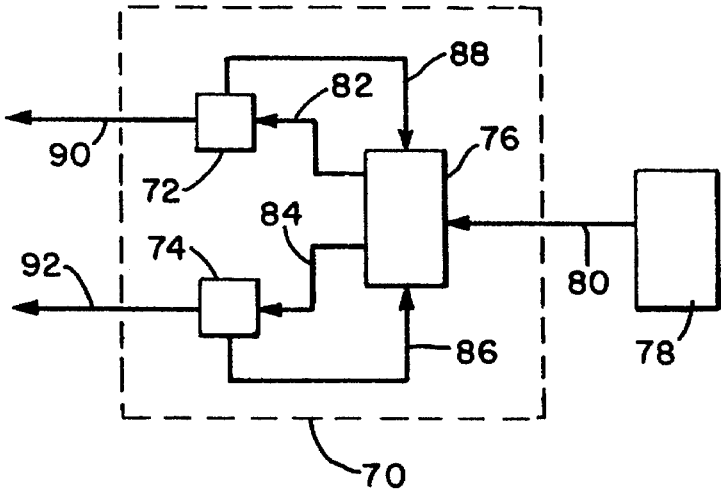
FIG. 6 is a block diagram of a control system which is a part of the shower system of the present invention.

Referring to FIGS. 1 and 6, cylinder 36 is a pneumatic-type cylinder and is fabricated from a non-magnetic metal, preferably stainless steel. A piston (not shown) is moveably disposed within cylinder 36 and is magnetically coupled to a sealed magnetic collar (not shown) that is positioned between carriage 44 and cylinder 36. The magnetic collar is sealed to prevent contact with moisture, the cleaning fluid and the input slurry. Carriage 44 is also fabricated from a non-magnetic metal, preferably stainless steel or aluminum. In a preferred embodiment, cylinder 36 and carriage 44 comprise a Bimba Ultran® Rodless Cylinder manufactured by the Bimba Manufacturing Company. Control system 70 controls the air flow into inlets 37 and 38 (see FIG. 1). Control system 70 comprises solenoid-type valve 76, switches 72 and 74. Valve 76 has an input connected to air conduit 80 which is connected to pressurized air supply 78. Switches 72 and 74 detect air pressure in air-conduit 90 and 92, respectively. Control system 70 is configured in a manner such that header 40 translates laterally or longitudinally as indicated by directional arrows 94 and 96 in response to air inputted to air inlets 37 and 38, respectively. For instance, as header 40 translates in the direction indicated by arrow 94, air is forced from the interior of cylinder 36 and into air line or conduit 90. The air pressure in line 90 remains constant until header 40 is positioned on the portion of cylinder 36 adjacent side 11*b* of apparatus 10. When header 40 is positioned adjacent side 11*b*, the pressure in line 90 decreases significantly since substantially all the air has been forced from the interior of cylinder 36. Threshold switch 72 detects when the air pressure decreases below a certain predetermined level and in response, sends a signal to valve 76 which shifts the flow of air from air conduit 84 to air conduit 82 which results in air being supplied to line 90 and hence, inlet 38. Due to the shift of air flow to line 90, header 40 now translates in the direction indicated by arrow 96. Similarly, as header 40 translates in the direction indicated by arrow 96, air is forced out of cylinder 36 and into air line or conduit 92. The air pressure in line 92 remains constant until header 40 is positioned on the portion of cylinder 36 which is adjacent side 11 a of apparatus 10. When header 40 is positioned on the portion of cylinder 36 which is adjacent side 11*a*, the pressure in line 92 decreases significantly since substantially all the air has been forced from the interior of cylinder 36. Threshold switch 74 detects when the air pressure decreases below a certain predetermined level and in response, sends a signal to valve 76 which shifts the flow of air from air conduit 82 to air conduit 84 which results in air being supplied to line 92, and hence inlet 37, thereby causing header 40 to translate again in the direction indicated by arrow 94.

As header 40 is translating upon support pipe 32, torque bar 34 and cylinder 36, a fluid is supplied to port 46 of header 40 via flexible hose 51. Hose 51 is swivably connected to header 40 via stainless steel swivel connector 52. Similarly, hose 51 is connected to feed pipe 48 via stainless steel swivel connector 50. Collar 49 provides a fluid tight connection between feed pipe 48 and swivel connector 50. Fluid pipe 48 is fluidly connected to high pressure fluid source 47. Source 47 contains a filter therein for filtering the fluid delivered to header fluid inlet port 46. Brackets 54 and 56 are mounted to the sides 11*a*, 11*b* of screening machine 10 via bolts 60 and support torque bar 34, cylinder 36 and support pipe 32. Brackets 54 and 56 also maintain the horizontal alignment of support pipe 32, torque bar 34 and cylinder 36. Bolts 58 secure brackets 54 and 56 to support pipe 32. Similarly, bolts 57 secure brackets 54 and 56 to the ends of cylinder 36.

Figure 7:
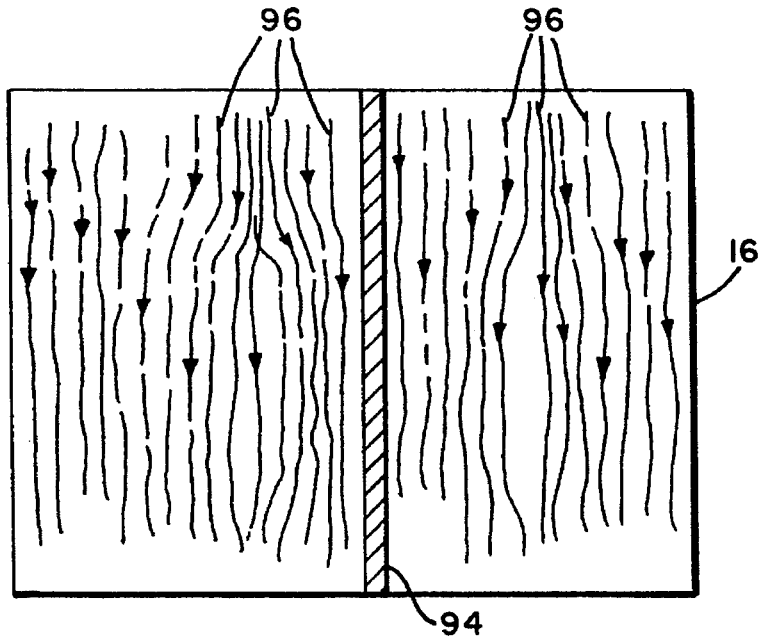
FIG. 7 is a view taken along line 7—7 of FIG. 2 and depicts the spray pattern as it impinges on a screen of the screening machine shown in FIG. 2

In a preferred embodiment, the pressure of the fluid supplied by fluid supply 47 is about 1000 p.s.i.g. However, fluids having pressures above or below 1000 p.s.i.g. can also be used. The distance from nozzles 28*a–f* can be varied depending on the nature of the feed slurry. In a preferred embodiment, shower system 12 is positioned at a distance from screen surface 24 that will result in the spray S (see FIG. 2) from nozzles 28*a–f* overlapping so as to allow the entire surface of screen 16 to be showered as header 40 translates longitudinally upon pipe 32, torque bar 34 and cylinder 36. Referring to FIG. 7, the aggregate of the spray patterns from nozzles 28*a–f* takes the form of a relatively narrow high-energy band 94 having a spray width less than 10 degrees and oriented parallel to feed stream 96. The spray from nozzles 28*a–f* deflect and pierces through feed or slurry stream 96 so that cleaning energy is concentrated upon screen 16 unencumbered by feed stream 96. As shown in FIG. 7, the narrow pattern or band 94 appears to be vertically oriented, but it will be understood that band 94 is arcuate due to the arcuate formation of nozzles 28*a–f*. Thus, band 94 follows the curvature of screen surface 16. High-energy spray band 94 enables the cleaning process to be carried out without shutting down the operation of screening machine 10 with attendant loss of time and production.

In a preferred embodiment, nozzle pipes 30, nozzles 28, header 40, support pipe 32 and torque bar 34 are fabricated from stainless steel in order to prevent corrosion. Support pipe 32 is of a sufficient strength to support header 40 and resist the thrust of the spray emanating from nozzles 28*a–f*. Torque bar 34 is of a sufficient strength to prevent rotation of header 40 about pipe 32 as a result of the thrust produced from the liquid spray emanating from nozzles 28*a–f*. Although cylinder 36 is a pneumatic-type cylinder, other types of drives can be utilized such as mechanical, reversible drives.

Since the spray nozzles are arranged in a vertical plane, the spray patterns S pierce the flow of feed upon screen surface 24 and wash a narrow band of screen surface 24. The entire screen surface 24 is washed as header 40 translates from one side of screen machine 10 to the other. The alternating translation of header 40 effects a 200% coverage for cleaning screen 24.

Since the present invention utilizes header 40 which translates laterally and does not rotate, the present invention is not as complex as the system disclosed in the '575 patent, which also provides axial rotation of nozzles. The present invention also utilizes bearings 62 and 64 to provide smooth contact with cylinder 36 and support pipe 32, respectively, thereby reducing friction during translation of header 40. Since the present invention does not rely on thrust of the spray patterns to move header 40, all of the spray is optimally directed to maximize cleaning of screen surface 24. The utilization of cylinder 36 and control system 70 results in a shower system that is reduced in size in comparison to the system disclosed in the '575 patent and which can easily be adapted to fit within the confines of screen housing 14. Due to the reduced number of components utilized in the present invention, shower system 12 can be manufactured at a reasonable cost. Furthermore, the reduced number of components facilitates maintenance of shower system 12.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

While the invention has been illustrated and described in what are considered to be the most practical and preferred embodiments, it will be recognized that many variations are possible and come within the scope thereof, the appended claims therefore being entitled to a full range of equivalents.

Thus, having described the invention, what is claimed is:

1. A shower system comprising;

a header having a fluid inlet port;

a plurality of substantially vertically aligned spray nozzles attached consecutively to the header and arranged in a substantially arcuate formation;

a cylinder having a first end and a second end, the cylinder having an air inlet adjacent each of the ends for introducing pressurized air into the cylinder, the header being slidably mounted upon the cylinder;

a piston disposed within the cylinder and magnetically coupled to the header, the piston moving laterally in response to the air pressure within the cylinder;

an elongated support member substantially parallel to the cylinder, the header slidably engaged with the elongated member;

a control system for supplying pressurized air to each of the air inlets in an alternate fashion to effect bi-directional lateral movement of the piston; and a torque bar substantially parallel to the elongated member and the cylinder, the header being slidably engaged with the torque bar, the torque bar preventing the header from axially rotating about the elongated member in response to a thrust produced by liquid jets that emanate from the plurality of nozzles.

2. The system of claim 1 further including an upper mostly nozzle positioned on an upper portion of said header, and a lowermost nozzle positioned on a lower portion of said header.

3. The system of claim 2 wherein said uppermost nozzle and lowermost nozzle are centerline spaced about 100 degrees apart.

4. The system of claim 3 wherein said plurality of nozzles comprises six (6) nozzles.

5. The system of claim 4 wherein each of said nozzles is centerline spaced about 20° from an adjacent one of said nozzles.

6. The system of claim 1 wherein said header is fluidly connected to a high pressure fluid source.

* * * * *